US011629535B2

(12) United States Patent
Kroll

(10) Patent No.: US 11,629,535 B2
(45) Date of Patent: Apr. 18, 2023

(54) SURFACE MOUNTED DOOR CHECK DEVICE

(71) Applicant: William Steven Kroll, Houston, TX (US)

(72) Inventor: William Steven Kroll, Houston, TX (US)

( * ) Notice: Subject to any disclaimer, the term of this patent is extended or adjusted under 35 U.S.C. 154(b) by 91 days.

(21) Appl. No.: 17/492,581

(22) Filed: Oct. 2, 2021

(65) Prior Publication Data

US 2022/0025684 A1 Jan. 27, 2022

Related U.S. Application Data

(66) Substitute for application No. 17/139,805, filed on Dec. 31, 2020, now abandoned.

(51) Int. Cl.
*E05C 17/36* (2006.01)
*E05C 17/22* (2006.01)

(52) U.S. Cl.
CPC ..... *E05C 17/36* (2013.01); *E05C 17/22* (2013.01)

(58) Field of Classification Search
CPC ..... E05C 17/36; E05C 17/22
See application file for complete search history.

(56) References Cited

U.S. PATENT DOCUMENTS 1,313,612 A * 8/1919 Stoiber ..... E05F 1/16 16/78
1,358,519 A * 11/1920 Carter ..... E05C 17/203 49/386

(Continued)

OTHER PUBLICATIONS

"DC-12 Door Controller",—https://web.archive.org/web/20200927043927/https://intechbearing.com/pages/urban-escape-products, (Sep. 27, 2020) (Year: 2020).*

*Primary Examiner* — Jeffrey O'Brien

(57) ABSTRACT

A surface-mounted device for controlling the swing/rotational motion of a hinged door/panel system. Said device controls the velocity of the door/panel's and provides check point(s) in the pathway of its motion. The device includes a non-pivoting carrier component to be fixed upon a hinged door/panel, a non-pivoting receiver component fastened to the adjacent and separate area which shares a common hinge(s)/axis with the movable door/panel and a flexible control arm component firmly attached at one end to the carrier. The flexible control arm is aligned with the receiver's through-body aperture by means of the carrier's fixed position on a movable hinged door/panel and provides control of the door/panel by means of passing into and through the aperture provisioned in the receiver in a linear manner to provide both speed and positional check control (motion detents) of the door's potential swing arc path. The speed control aspect of the device is accomplished by means of controlled frictional contact between the flexible control arm's component material(s) and the receiver's aperture and this effect is enhanced by means of the temporary physical deformation exhibited by the flexible control arm whilst it is undergoing loading stresses as it passes within the constriction of the receiver's aperture geometry, its component materials and the energized spherical element acting upon the wide surface of the flexible control arm by limiting frictional contact between the flexible control arm and the receiver's aperture when the energized spherical element is not engaged with the flexible control arm's provisioned negative areas(s) and the attached door/panel is in motion. Maximum frictional force is delivered by the device when the spherical element engages a provisioned negative area on the flexible control arm, thus creating a check in the door/panel swing path. The device may be added/retrofitted to the surfaces of a pre-existing or new hinged door/panel system without significant design or structural modifications of said hinged door/panel systems and their associated components.

21 Claims, 5 Drawing Sheets

(56) References Cited

Figure 1:
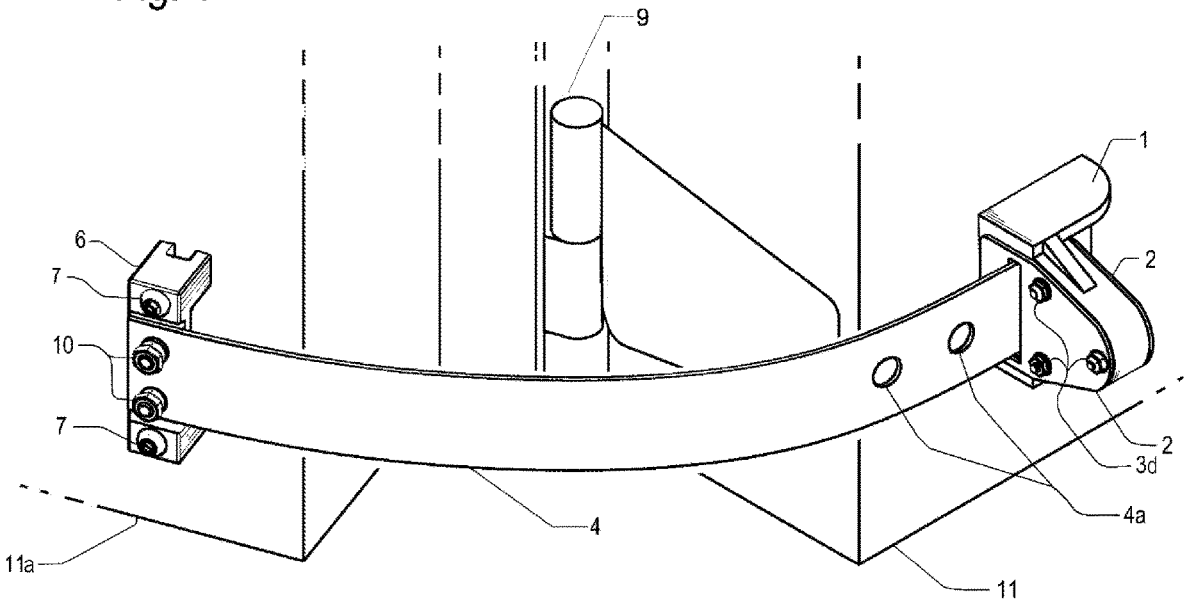

U.S. PATENT DOCUMENTS 1,588,477 A * 6/1926 Kingston ..... E05C 17/36 16/82
1,646,580 A * 10/1927 Eastman ..... E05C 17/203 16/82
1,757,261 A * 5/1930 Simmons ..... E05C 17/36 16/82
1,819,212 A * 8/1931 Toncray ..... E05C 17/36 16/82
1,832,708 A * 11/1931 Hughes ..... E05C 17/203 16/82
1,837,517 A * 12/1931 Ball ..... E05C 17/36 16/82
RE18,397 E * 3/1932 Eastman ..... E05C 17/203 16/82
1,850,229 A * 3/1932 Eastman ..... E05C 17/203 16/82
2,187,941 A * 1/1940 King ..... E05C 17/36 292/262
2,232,986 A * 2/1941 Westrope ..... E05C 17/203 16/86 C
3,570,043 A * 3/1971 Knudson ..... E05C 17/36 217/60 R
5,173,991 A * 12/1992 Carswell ..... E05C 17/203 16/334
6,711,778 B2 * 3/2004 Sparkman ..... E05C 17/203 16/82
6,901,630 B2 * 6/2005 Liang ..... E05C 17/203 16/86 B
6,948,214 B2 * 9/2005 Spalding ..... E05D 11/1085 16/83
8,549,711 B2 * 10/2013 Apostoloff ..... E05D 11/06 16/374
9,248,871 B1 * 2/2016 Waskie ..... E05C 17/36
10,519,701 B2 * 12/2019 Patterson ..... E05C 17/206
2021/0016922 A1 * 1/2021 Leng ..... B65D 43/165

* cited by examiner

SURFACE MOUNTED DOOR CHECK DEVICE

BACKGROUND OF THE INVENTION

Various types and design of door check and swing control devices and systems of hinged panel systems have been designed for the safety and convenience of the user. Such systems provide for various hold-point positions along the path of a hinge's movement and those panels attached to them. For example, it is common for vehicle doors to be supplanted with door check control systems allowing the door to stop at various points along the potential swing path of the door. It is desirable for the door to maintain a partially or fully open position to oppose natural weather conditions like wind loading as well as inclined vehicle positions for the safe ingress and egress of the vehicle's user. This same concept has been extended, albeit, for use in various foldable forms such as luggage, tool/storage boxes, portable devices, space dividers etc. wherein it is desirable to inhibit the swing of the hinged system in one or more predetermined positions.

In most automotive door check systems, the components are, at least partially, built into the bodywork of the vehicle. There are, however, instances in the automotive realm wherein a built-in door check system either isn't fitted by the carmaker and/or having a built-in door check is a hindrance. This situation would be exemplified for vehicles with doors that are designed to be removed from the vehicle by the user with the minimum of time and complexity.

U.S. Pat. No. 1,646,580 discloses a door check system that was designed to displace the door stop strap that is still found in some vehicles with doors designed to be easily removed by the user. Said device uses a primarily flat strap which is designed to maintain a relatively straight line when in use preventing buckling. This system, however, does not lend itself to ease of door removal and is limited to a single door restraint position.

U.S. Pat. No. 6,948,214 discloses a removable device for holding an automotive door in the open position. Designed primarily for use on a vehicle during the assembly process, this device is designed to be placed onto the vehicle's door hinge pin, it is made of a flexible material such as steel. It is limited by its provisioning only a single door position as well as the necessity to attach the device each instance that the user wants to keep the vehicle door in the fully open position and the device must be removed in order to close the door.

U.S. Pat. No. 6,901,630 discloses a door check device in which a formed arm allows for multiple stops in the door's swing path by means of spring energized rollers which press upon the formed planes of the formed pivoting arm. Its dual roller design effectively maintains alignment of the pivoting formed arm relative to the vehicle's body, however, checks in the door swing motion are limited to those provisioned in the formed arm. This limitation requires additional tool forming of the door check arm for doors of different styles and weights.

U.S. Pat. No. 6,711,778 discloses a door check device in which a substantially flat bar controls the door's swing by way of at least one spring energized roller making contact with the shorter edge. This short edge has predetermined contours upon which the sprung roller rides, providing various levels of resistance to the swing of the door. The relatively small contact area between the roller and the bar forces the utilization of a high spring rate which increases wear on the components and requires high precision alignment of the system's components relative to each other, which in turn, increases the cost to manufacture.

It is therefore desirable to offer a door check system which overcomes the many shortcomings of previous designs. Because the majority of vehicular door check applications deal with doors of various weights and sizes, most door check designs are bespoke for their intended application and, therefore, require specialized tooling, forging and engineering to fulfill their mission effectively. My new design overcomes many of those stated limitations of earlier designs and is a more universal design for a wide range of doors.

BRIEF SUMMARY OF THE INVENTION

My Surface Mounted Door Check Device provides an economical, lightweight and adaptable means of adding intermediate door check stops to a hinged door/panel's swing path. This novel design, once installed, allows for tool-free separation of the door from its adjacent frame/body receiver connection. The design utilizes engineered materials to provide frictional control as a means of controlling the velocity of the door/panel's swing motion. The intermediate door check stop(s) are provisioned as negative areas within the flexible control arm for the requirements of the application. The system is adaptable to accommodate for the weight and size of a wide range of doors/panels.

Previous door check systems and devices are relatively complex mechanical devices. My new design has only three distinct components, the carrier, the flexible control arm and the receiver, all of which are surface mounted.

My new door check design allows the system to be installed on the surface of the inboard side of an outward swinging door. Because of the unique component design, this can be accomplished on most vehicles with removable doors without modifying the bodywork or chassis.

Previous and current door check systems often require lubrication. Lubricants often attract dust, dirt and other particulates which are detrimental to the door check device and its operational characteristics. This new design, optionally, uses a single self-lubricating plain bushing to reduce friction between the energized spherical element and the compression spring housed within the receiver when required by the application.

Many other designs of door check devices utilize a a pivoting rigid component to connect a door component to an adjacent frame area/bodywork component of the door check system. My new design requires no pivots instead utilizing a flexible control arm component to make the door to frame/bodywork connection.

The flexible control arm component of my new design may be provisioned with negative spaces/areas(s) which, by their size, shape and spacing, provides points of control for the intermediate swing check(s). The material properties of the flexible control arm, such as thickness, width, surface hardness, texture and stiffness contribute to control of the velocity of the door swing motion.

My new door check system is provisioned with an energized spherical element, which interacts with the negative space(s) provisioned within the flexible control arm. It is energized by the use of a compression spring. The energized spherical element, the compression spring and the optional plain bearing are housed within the receiver component.

The flexible control arm, spherical element and compression spring may be replaced with ease for other like-kind parts while being of different engineering/material characteristics and/or compressive force to accommodate for different static and dynamic loading and the varying weight, mass and size of the panels/doors to be controlled.

A BRIEF DESCRIPTION OF THE DRAWINGS

FIG. 1 Is a perspective view of the preferred embodiment of the invention as it may be applied to a door 11*a* and chassis 11.

Figure 2:
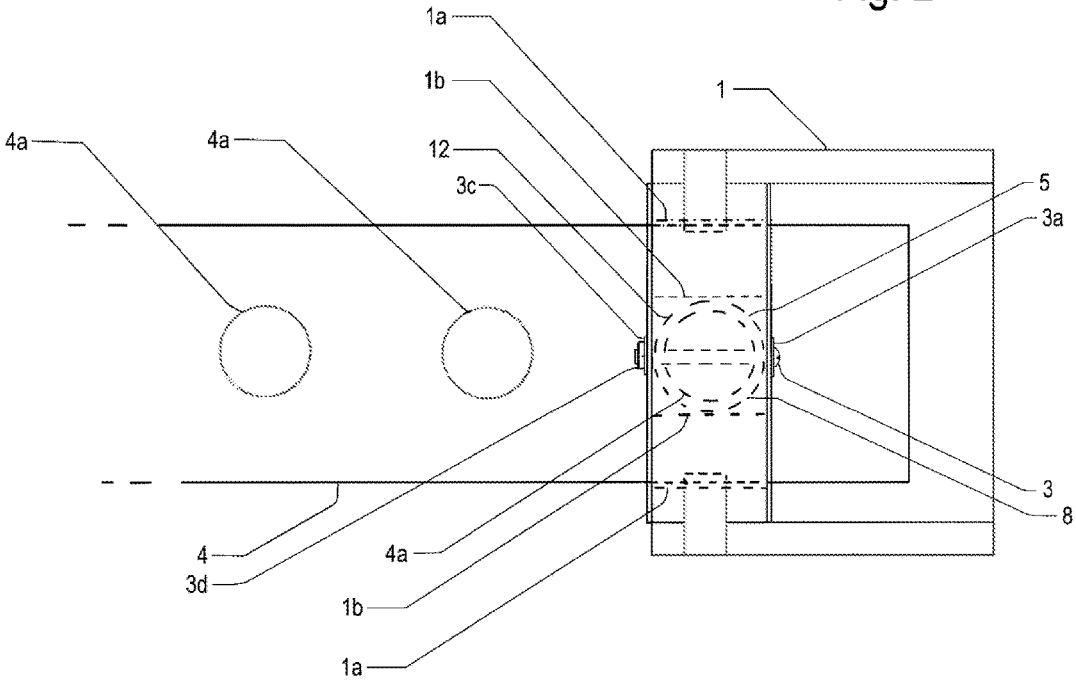

FIG. 2 is a cross-section schematic top view of the receiver body 1, as well as, the flexible control arm 4, a spherical element 12, a compression spring 5, a flanged bushing 8, receiver covers 2 and fasteners 3.

Figure 3:
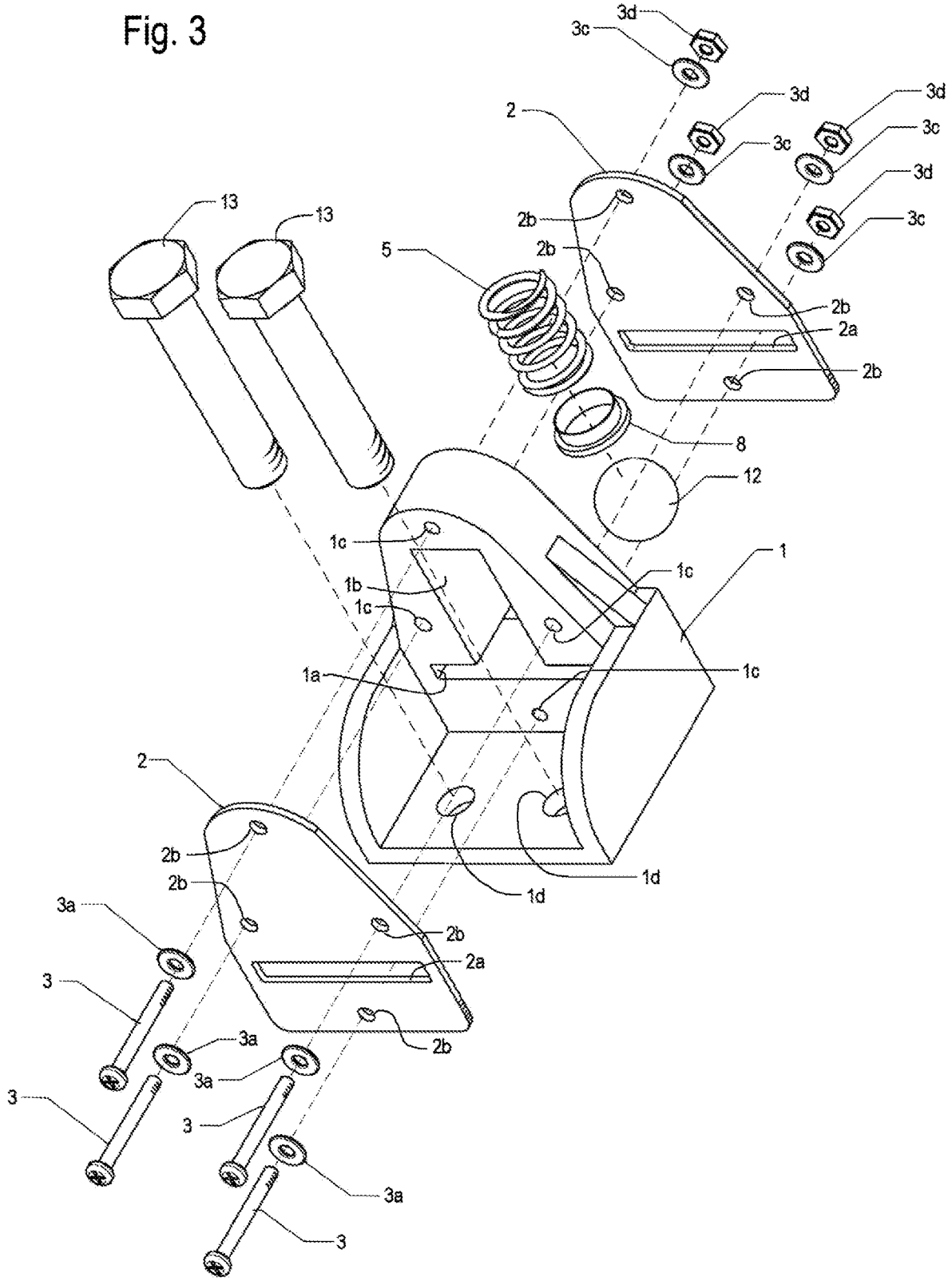

FIG. 3 is an exploded, isometric view of the receiver.

Figure 4:
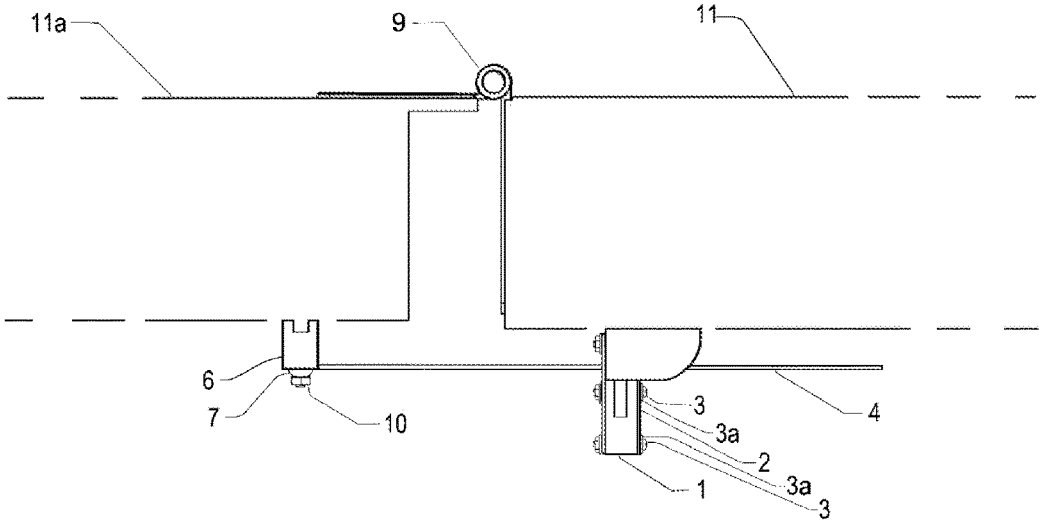

FIG. 4 Is a top view of the invention as it may be applied to a door 11*a*, chassis 11 and hinge 9 that are in a primarily closed position.

Figure 5:
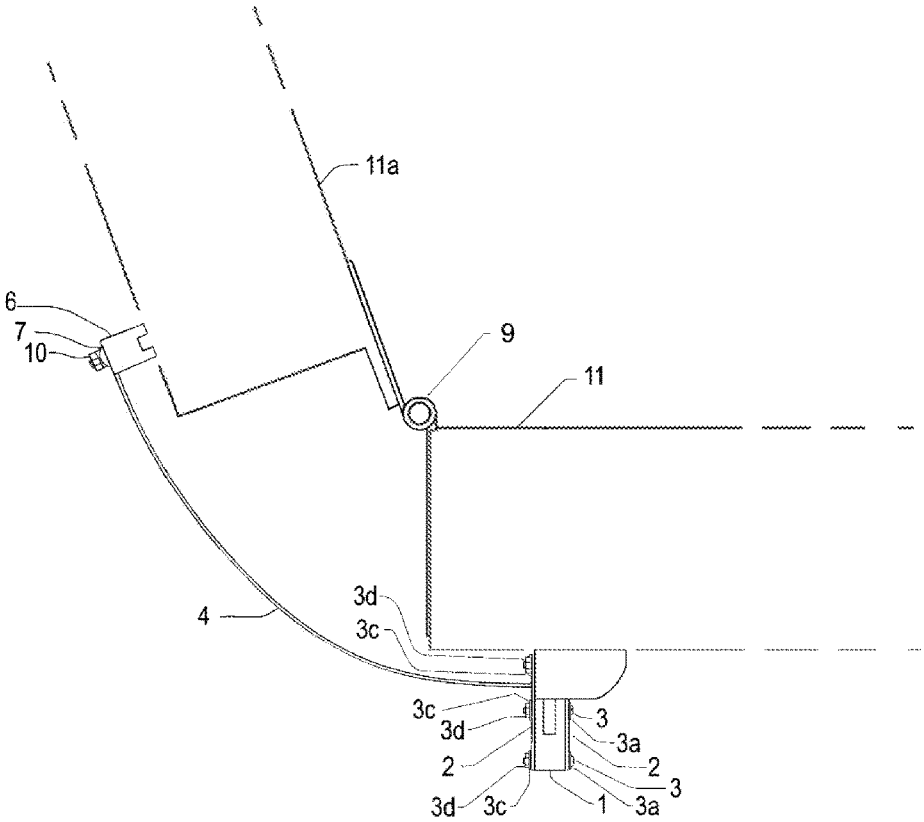

FIG. 5 illustrates the same parts as described in FIG. 4 and the door 11*a*, by way of rotation upon the hinge 9 is now seen in at least a partially open position.

Figure 6:
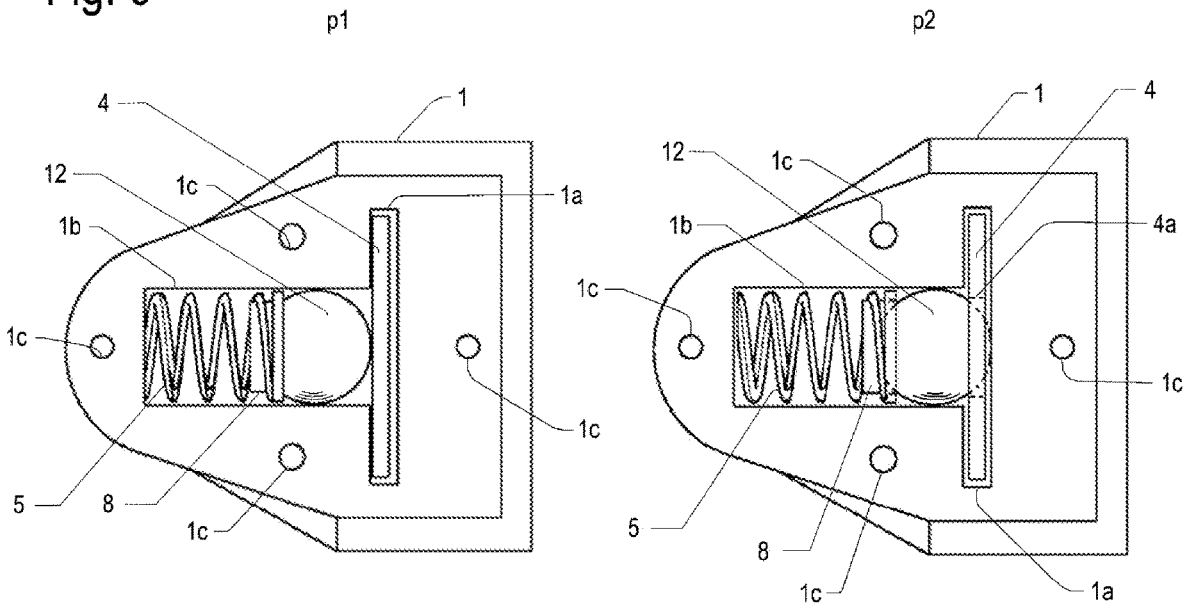

FIG. 6 Illustrates examples of two possible conditional positional states which are labeled as drawings p1 and p2 of the components contained within the receiver 1 when they may interact with the linear motion of the flexible control arm 4 and its provisioned negative areas 4*a*.

Figure 7:
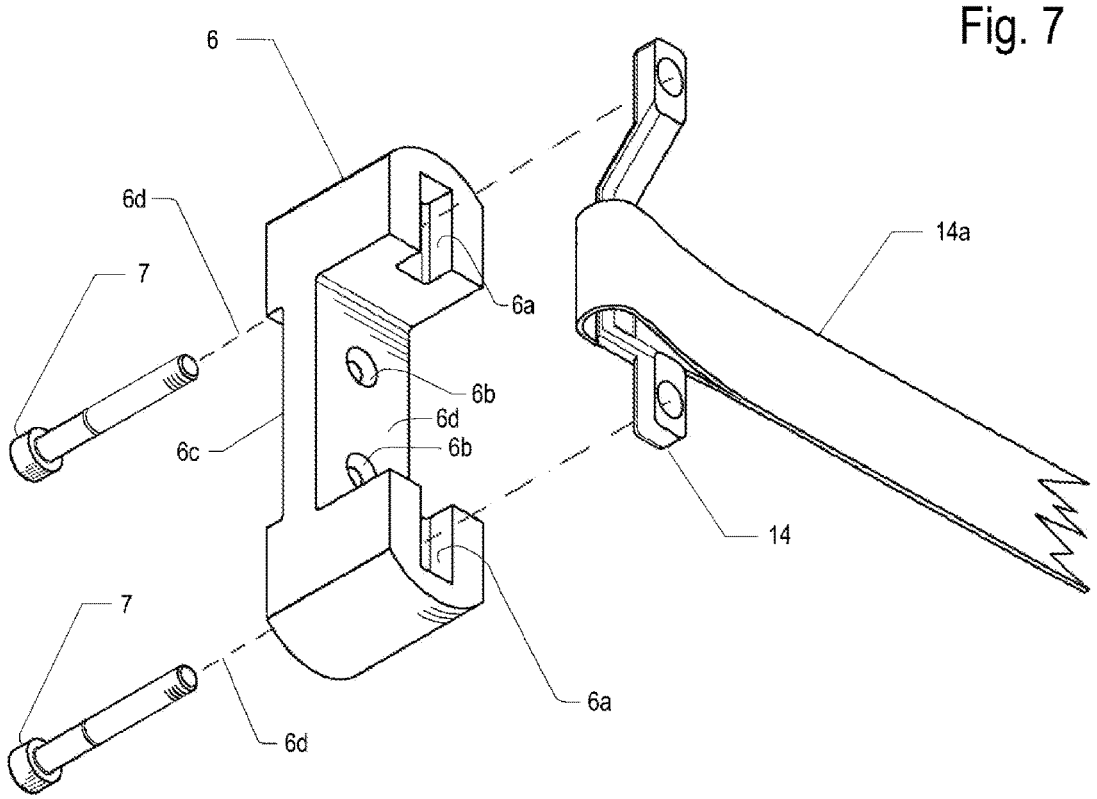
Figure 9:
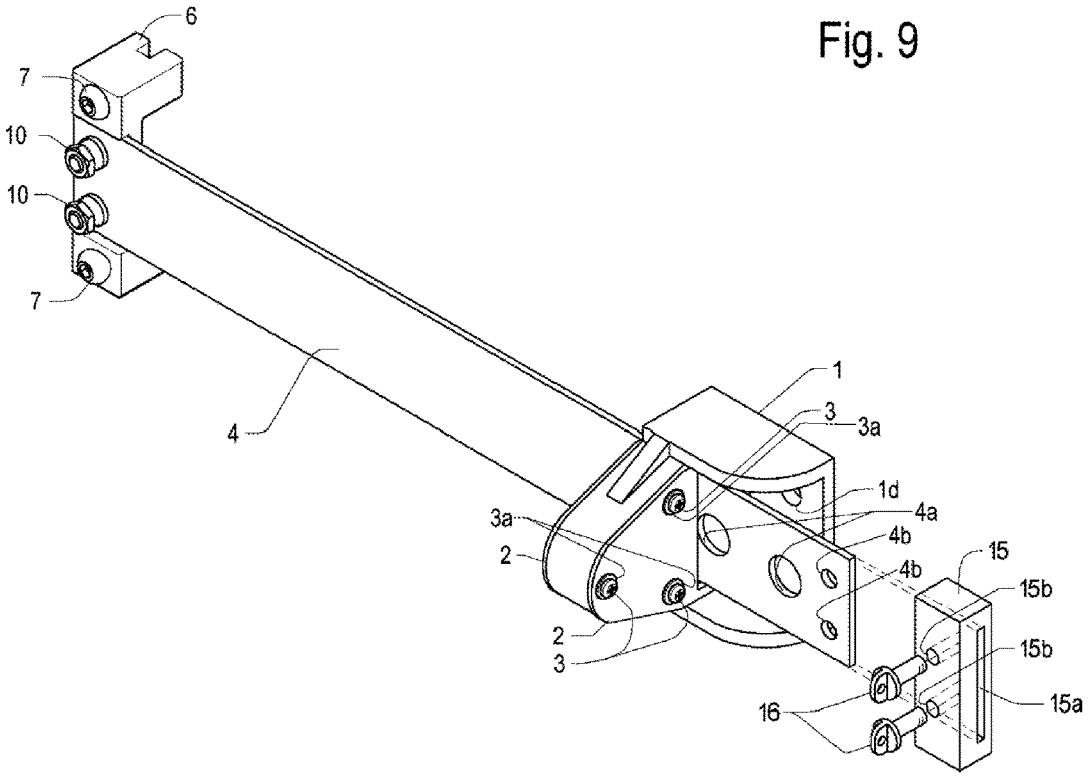

FIG. 7 Is an isometric view of the underside, that partial portion of the carrier 6 which may make contact with a pre-existing surface(s) and showing features 6*a* and 6*d* which are negative spaces provisioned within the carrier's 6 body associated bracket 14 further lessens the need for the use of an optional door limiting stop block 15 as seen in FIG. 9

Figure 8:
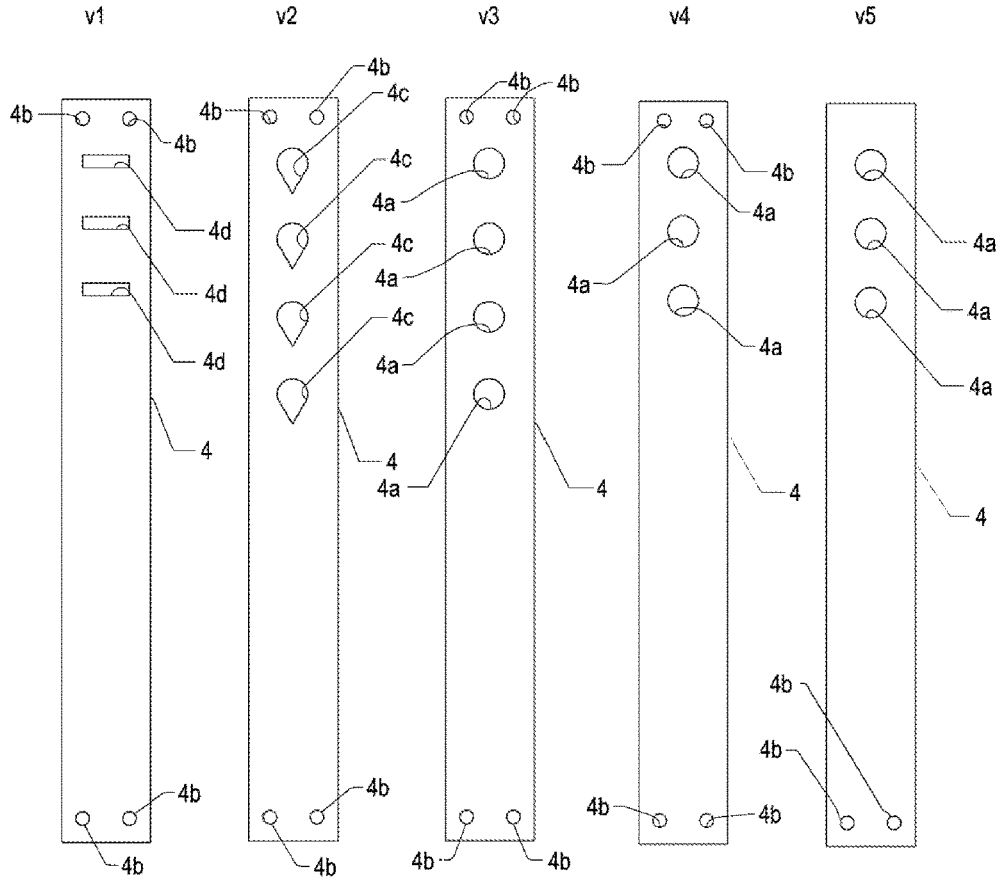

FIG. 8 Shows five possible configuration examples of negative spaces which may be provisioned for the flexible control arm 4. As labeled, negative areas illustrated are door 11*a* swing check points for the invention. Said examples are illustrated and labeled as v1, v2, v3, v4 and v5.

FIG. 9 Is an isometric view of the invention in an unmounted state.

DESCRIPTION OF THE PREFERRED EMBODIMENT

FIG. 1 Is a perspective view of the preferred embodiment of the invention as it may be applied to a door 11*a* and chassis 11, which is shown in a partially open position as viewed from the interior of a vehicle. The door 11*a* rotates about a fixed axis upon a pre-existing hinge assembly 9, the axis of which is ostensibly parallel with the nearest edges of the pre-existing chassis 11 and the pre-existing door 11*a*.

In this embodiment of the invention, the flexible control arm 4 is fixed to the carrier 6 with fasteners 10, which is in turn, fixed to a door 11*a* with fasteners 7 and bridges across the door 11*a*, hinge 9 and into the receiver 1, which is fixed to the chassis 11. The installed position of the invention is reversible, wherein the receiver body 1 may be fixed to a door 11*a* and the carrier 6 with the fixedly attached flexible control arm 4 which may be attached to the chassis 11 without a loss of functionality.

Check points for control of the door 11*a*, to which the invention may be installed upon, the swing of which, is controlled, at least in part, via the negative spaces 4*a* as provisioned within the body of the flexible control arm 4. The size, shape and spacing of these negative spaces 4*a* may be determined by the requirements of the specific application as well as the user's preferences.

The receiver body 1 is enclosed with two receiver covers 2 which are attached to opposing sides of the receiver's body 1 with fastener parts labeled 3, 3*a* and 3*b*. The fastening(s) may be of any suitable type or nature to address the needs of the application and/or the ease of manufacturability of the invention and all that entails.

FIG. 2 is a cross-section schematic top view of the receiver body 1, as well as, the flexible control arm 4, a spherical element 12, a compression spring 5, a flanged bushing 8, receiver covers 2 and fasteners 3. In this view the negative space feature 4*a* of the flexible control arm 4 is aligned with the energized spherical element 12 which is located at this point of its travel through the receiver's 1 negative area 1*a*, thus creating a check, which may also be described as a point of higher than normal friction within the system's operational parameters. Located within the receiver's 1 negative area labeled 1*b* are components nearest the viewer in descending vertical order, the compression spring 5, the flanged bushing 8, the spherical element 12 and the flexible control arm 4.

The flanged bushing 8 which may have a self-lubricating property, is placed between the spherical element 12 and the compression spring 5 acts and may act as an anti-friction bearing facilitating potential, and desirous property of rotational motion of the spherical element 12 as the flexible control arm 4 may pass in a linear direction beneath its surface. Said component group is oriented in a perpendicular geometry in relation to one of the two widest faces of the flexible control arm 4. This arrangement may place the energized spherical element 12 in alignment and in forced contact with the potential travel pathway of the flexible control arm 4 and, in particular, with its provisioned negative spaces 4*a*. The flexible control arm 4 is held in alignment with the aforementioned components within a boundary 1*a* formed as a negative spatial feature within the carrier body 1 and primarily and generally rectangularly shaped through-slots 2*a* which are provisioned in the receiver covers 2.

FIG. 3 is an exploded, isometric view of the receiver body 1 exhibiting a cavity defined by, and as seen in this drawing viewpoint as, a primarily vertical negative section which is marked as area 1*b* and of which, when assembled, partially encloses the spherical element 12 which is located, as illustrated, at the lowest point within this area, the flanged bushing 8 rests immediately both above and upon the spherical element 12 and at the top of this described area is the compression spring 5. The outer, non-flanged diameter of the bushing 8 is designed so as to be inserted within the inner diameter of the compression spring 5 with the lowest portion of the compression spring 8 retained by the top surface of flanged section of said bushing 8.

The lower section of negative area 1*b* of the receiver 1 is shown as being of a primarily horizontal area in appearance and is marked as area 1*a*. Negative area 1*a* will be occupied primarily, when assembled, by the flexible control arm 4. The negative area 1*a*, as aforementioned, extends through the receiver body 1.

Enclosing the receiver body 1 are two receiver covers 2 which may be provisioned with thru-holes 2*b* which align with and receiver 1 provisioned thru-holes 1*c* in the receiver body 1. Alignment of the aforementioned negative spaces 2*b* and 1*c* facilitates the use of mechanical fastener components 3, 3*a*, 3*b*, 3*c* and 3*d* which pass through all three of these components, namely two of receiver covers 2 and one receiver body 1, to constrain and assist in containing the compression spring 5, the flanged bushing 8 and the spherical element 12 as an aligned assembly within the receiver body 1. The two receiver covers 2 are also provisioned with negative through-holes 2*a* which generally align with negative area 1*a* in the receiver body.

The receiver body 1 is may also be provisioned with through-holes 1*d* which may allow mechanical fasteners 13 to attach the receiver body 1 to a chassis, of any manner, as illustrated in FIG. 1. The design of, or the provisioning of, said through-holes is dependent on the particular application and/or facilitating the ease of manufacture of the invention and its associated componentry.

FIG. 4 Is a top view of the invention as it may be applied to a door 11*a*, chassis 11 and hinge 9 that are in a primarily closed position. We see, herein, the carrier 6 and the flexible control arm 4 which may be fixedly attached by means of mechanical fasteners 10 and the carrier body 6 is affixed to the pre-existing door 11*a* with fasteners 7. When said door 11*a* and chassis 11 are in this closed position it should be noted that the flexible control arm 4 is primarily straight in shape and in alignment with negative spaces 2*a* as provisioned in the carrier covers 2 and also with 1*a* as a negative space within the receiver body 1.

FIG. 5 illustrates the same parts as described in FIG. 4 and the door 11*a*, by way of rotation upon the hinge 9 is now seen in at least a partially open position. It should be noted that the flexible control arm 4, which is fixedly attached to the carrier body 6, is now distorted into an arc shape by the rotation of the door 11*a*. Said rotation of the door 11*a* has increased the base distance between the carrier body 6 in relation to the receiver body 1 and the flexible control arm 4 which has been positioned into the receiver body 1 by means of the provisioned space 1*a* as seen in FIG. 3.

FIG. 6 Illustrates examples of two possible conditional positional states which are labeled as drawings p1 and p2 of the components contained within the receiver 1 when they may interact with the linear motion of the flexible control arm 4 and its provisioned negative areas 4*a*. Said linear motion is the result of a converted and conveyed rotational motion of the door 11*a* as it may be rotated on the hinges 9 in relation to the receiver 1 when said receiver 1 is, or may be, utilized as a stationary element in the invention being fixedly mounted to the chassis 11.

Both illustrations p1 and p2, show through-holes 1*c*, which may be provisioned wherein the use of mechanical fasteners 3, 3*a*, 3*c* and 3*d* may be desirable. The use of and/or style and nature of said fasteners is variable as to the application of the invention or its ease of manufacture.

In illustration p1 we see a cross-sectional view of the receiver body 1 and the flexible control arm 4 with the compression spring 5 in its most compressed state as the flexible control arm 4 is occupying negative space 1*a* in the receiver body 1 but has not yet reached a potential check position 4*a* as provisioned on the flexible control arm 4. In this positional state, the spherical element 12 is riding on the primary positive (non-negative) surface of the flexible control arm 4.

The second illustration of FIG. 6 is p2 which Is a cross-sectional view of the receiver body 1 and the flexible control arm 4 with the compression spring 5 in its most distended state. This new state of relationship between the aforementioned parts of the invention is also known as a check state and is the result of the flexible control arm 4 having travelled in a linear manner within negative space 1*a* and with the spherical element 12 having travelled vertically into a negative space 4*a* which may be provisioned on the flexible control arm 4 by means of the of the stored energy in the compression spring 5.

FIG. 7 Is an isometric view of the underside, that partial portion of the carrier 6 which may make contact with a pre-existing surface(s) and showing features 6*a* and 6*d* which are negative spaces provisioned within the carrier's 6 body. The spaces labeled 6*a* and 6*d* are designed so that may facilitate the integration with and incorporate the use of a pre-existing door limiting strap 14*a* and its pre-existing door limiting strap bracket 14 over which the carrier body 6 may be placed. In this feature 6*a* the fasteners 7 may secure both the carrier body 6 and the pre-existing door limiting strap bracket 14 to a door 11*a* as seen in FIG. 1. Door limiting straps 14*a* are common on vehicles which feature removable doors and it may be desirable to maintain the existing door limiting strap 14*a* as it often carries electrical wiring within. Maintaining the existing limiting door strap 14*a* and its associated bracket 14 further lessens the need for the use of an optional door limiting stop block 15 as seen in FIG. 9

FIG. 8 Shows five possible configuration examples of negative spaces which may be provisioned for the flexible control arm 4. As labeled, negative areas illustrated are door 11*a* swing check points for the invention. Said examples are illustrated and labeled as v1, v2, v3, v4 and v5. as to the variable quantity, size and shape options for negative spaces which may, but are not limited, to be provisioned within the flexible control arm 4 body to enable possible door 11*a* swing check points. Also pictured are provisioned through-holes 4*b* which may be used as mounting points for connecting fasteners to required or optional components as a part of the invention and its particular application requirements. All of the negative spaces illustrated may vary in size in relation to the application and the components being provisioned for various applications of the invention.

Illustrated in drawing v1 are three negative check point location spaces 4*b* on the flexible control arm 4. These have a primarily rectangular form. You will also see four through-holes 4*b* for mechanical attachment.

In drawing v2 we see the flexible control arm 4 provisioned with four ovoid teardrop shaped negative areas 4*c* check point locations. You will also see four through-holes 4*b* for mechanical attachment.

Illustration v3 shows another variation with four spherical negative areas 4*a* check point locations. You will also see four through-holes 4*b* for mechanical attachment.

Drawing v4 shows three spherical negative spaces 4*a* check point locations. The number and size of negative spaces is variable and may be utilized in a manner that is befitting the application. You will also see four through-holes 4*b* for mechanical attachment.

In drawing v5 there are only two through-holes 4*b* on the flexible control arm 4 to illustrate that in some applications there is variability in the number (and size) of potential fasteners to be used in the invention, dependent on the needs of the particular application. In this instance, there is no requirement for the stop-block 15 assembly as seen in FIG. 9. There are three spherical negative spaces 4*a* check point locations on the flexible control arm 4.

FIG. 9 Is an isometric view of the invention in an unmounted state. It should be noted that in this variation, an optional stop-block 15 is shown. This optional element is useful when the vehicle lacks an existing and/or installed door limiting strap 14*a* as seen in FIG. 7. The stop block assembly 15 features a through-slot 15*a* to accept entry of the flexible control arm 4. The stop-block 15 also features tool-free fasteners 16 of any design. In practical application, the flexible control arm 4 passes through receiver cover(s) 2 by way of provisioned through areas 2*a*, the receiver 1 in a linear manner by way of area 1*a*, and its attached and finally into the body of the stop-block's provisioned through-slot 15*a* where said component may be provisioned with through-holes 15*b* which may be brought into alignment with the two through-holes 4*b* on the flexible control arm 4. The tool-free fasteners 16 may be of any practical and applicable nature may then be inserted into and through the provisioned through-holes 15*b* located on the stop-block 15 as well as the through-holes 4*b* located on the flexible control arm 4 thus fixedly retaining the stop-block 15 in a pre-determined area upon the flexible control arm 4.

What is claimed is:

1. A surface mounted door check device, comprising:

a receiver body for attachment to a frame, the receiver body comprising a cavity having a first portion and a second portion, a compression spring and a spherical element contained within the cavity first portion such that the spherical element is biased toward the cavity second portion;

a carrier for attachment to a door;

a flexible control arm having a first end and a second end, the first end of the flexible control arm fixedly attached to the carrier such that the first end of the flexible control arm moves together with the carrier, the second end of the flexible control arm comprising a plurality of openings extending slidably through the cavity second portion;

a stop block for limiting a maximum range of movement of the flexible control arm with respect to the receiver body, the stop block comprising a through slot for receiving the second end of the flexible control arm, and further comprising tool-free fasteners for removably connecting the stop block to the second end of the flexible control arm; and wherein movement of the door with respect to the frame moves the carrier and the first end of the flexible control arm such that the second end of the flexible control arm slides through the cavity second portion, each of the plurality of openings corresponding to a respective check position when a respective one of the plurality of openings is aligned with the spherical element.

2. The surface mounted door check device of claim 1, wherein the compression spring and spherical element exert friction upon the flexible control arm as the flexible control arm travels through the cavity second portion of the receiver body for controlling a relative speed between the door and frame.

3. The surface mounted door check device of claim 1, wherein the flexible control arm has a body with a rectilinear shape having a length, width, and thickness.

4. The surface mounted door check device of claim 1, wherein a portion of the spherical element is inserted into the plurality of openings in the flexible control arm in a direction extending 90 degrees with respect to a plane of the flexible control arm.

5. The surface mounted door check device of claim 1, wherein the flexible control arm is composed of a high-pressure fiberglass laminate or carbon fiber composite material.

6. The surface mounted door check device of claim 1, wherein the stop block prevents unwanted withdrawal of the flexible control arm from the receiver body.

7. The surface mounted door check device of claim 1, wherein the stop block is composed of a shock absorbing material.

8. The surface mounted door check device of claim 1, wherein the plurality of openings are circular-shaped.

9. The surface mounted door check device of claim 1, wherein the plurality of openings are rectangular-shaped.

10. The surface mounted door check device of claim 1, wherein the plurality of openings are ovoid teardrop-shaped.

11. The surface mounted door check device of claim 1, wherein the plurality of openings comprises three openings.

12. The surface mounted door check device of claim 1, wherein the plurality of openings comprises four openings.

13. The surface mounted door check device of claim 1, wherein the receiver body further comprises mounting holes.

14. The surface mounted door check device of claim 13, wherein the mounting holes of the receiver body are spaced apart and configured to align with existing fasteners of the frame.

15. The surface mounted door check device of claim 1, wherein the receiver body further comprises an aperture configured to accommodate the stop block.

16. The surface mounted door check device of claim 1, wherein the spherical element is formed of a metallic alloy, compression formed powdered metal, phenolic, or plastic material.

17. The surface mounted door check device of claim 1, wherein the spherical element is lubricous.

18. The surface mounted door check device of claim 1, further comprising a flanged bushing having a non-flanged end inserted within an inner diameter of the compression spring and a flanged end configured to engage the spherical element.

19. The surface mounted door check device of claim 18, wherein the flanged bushing comprises a self-lubricated material.

20. The surface mounted door check device of claim 1, wherein the carrier comprises a recess on a rear side for accommodating a pre-existing door retention strap.

21. The surface mounted door check device of claim 1, wherein the carrier comprises mounting holes, wherein the mounting holes of the carrier are spaced apart and configured to align with existing fasteners of the door.

* * * * *